US006186696B1

(12) United States Patent
Valin

(10) Patent No.: US 6,186,696 B1
(45) Date of Patent: Feb. 13, 2001

(54) METHOD FOR THE CROSSWISE SHRINKING OF A CYLINDRICAL PART IN A TUBULAR PART, TOOL KIT FOR ITS IMPLEMENTATION, AND ASSEMBLY OF TWO CORRESPONDING PARTS

(75) Inventor: Daniel Valin, Saint-Amand-sur-Fion (FR)

(73) Assignee: Vallourec Composants Automobiles Vitry, Vitry-le-Francois (FR)

( * ) Notice: Under 35 U.S.C. 154(b), the term of this patent shall be extended for 0 days.

(21) Appl. No.: 09/101,394

(22) PCT Filed: Dec. 23, 1997

(86) PCT No.: PCT/FR97/02402

§ 371 Date: Sep. 18, 1998

§ 102(e) Date: Sep. 18, 1998

(87) PCT Pub. No.: WO98/29207

PCT Pub. Date: Jul. 9, 1998

(30) Foreign Application Priority Data

Dec. 31, 1996 (FR) ..... 96 16302

(51) Int. Cl.[7] ..... F16D 17/00; F16D 9/00

(52) U.S. Cl. ..... 403/306; 403/347; 403/281; 403/282; 403/283; 29/509

(58) Field of Search ..... 403/345, 346, 403/347, 243, 283, 281, 282; 29/509

(56) References Cited

U.S. PATENT DOCUMENTS

| | | | | |
|---|---|---|---|---|
| 2,614,827 | * | 10/1952 | Peach et al. | 29/509 |
| 3,068,029 | * | 12/1962 | Schwartz | 29/509 |
| 3,320,843 | * | 5/1967 | Schott | 83/620 |
| 3,344,370 | * | 9/1967 | Sewell | 29/509 |
| 3,925,875 | | 12/1975 | Doke . | |
| 4,321,068 | * | 3/1982 | Cottrell et al. | 29/525 X |
| 4,676,427 | * | 6/1987 | Constance | 228/189 |
| 4,776,155 | * | 10/1988 | Fox et al. | 56/220 |
| 4,836,705 | * | 6/1989 | La Barge et al. | 29/509 X |
| 5,415,443 | * | 5/1995 | Hayashi | 29/511 X |
| 5,517,744 | * | 5/1996 | Moser et al. | 29/509 |
| 5,666,840 | * | 9/1997 | Shah et al. | 29/421.1 X |
| 5,882,139 | * | 3/1999 | Valin | 403/347 |

FOREIGN PATENT DOCUMENTS

| | | | | |
|---|---|---|---|---|
| 383303 | * | 8/1959 | (CH) . | |
| 383 303 | | 10/1964 | (CH) . | |
| 1950086 | * | 10/1968 | (DE) | 403/346 |
| 1452820 | * | 5/1969 | (DE) | 29/509 |
| 937641 | * | 12/1946 | (FR) | 403/347 |
| 2426506 | * | 5/1978 | (FR) . | |
| 2371252 | * | 7/1978 | (FR) | 29/509 |
| 2 426 506 | | 12/1979 | (FR) . | |

* cited by examiner

*Primary Examiner*—Lynne H. Browne
*Assistant Examiner*—Ernesto Garcia
(74) *Attorney, Agent, or Firm*—Young & Thompson

(57) ABSTRACT

An assembly (10) formed of two parts pressed together in cruciform arrangement comprises a cylindrical part (11) and a tubular part (12). The tubular part (12) has a transverse hole (14) bordered by rims (18) extending toward each other. A spacer (16) in the form of a ring is inserted between the walls (15) of the tubular part (12), surrounding the region where the hole is to be formed. The rims are then deflected toward each other into engagement with the interior of the ring, the ring having a height equal to the distance between the walls (15). Thus, the ring (16) braces the tubular part (12) internally around the hole (14).

9 Claims, 2 Drawing Sheets

METHOD FOR THE CROSSWISE SHRINKING OF A CYLINDRICAL PART IN A TUBULAR PART, TOOL KIT FOR ITS IMPLEMENTATION, AND ASSEMBLY OF TWO CORRESPONDING PARTS

FIELD OF THE INVENTION

The present invention concerns the pressing of an at least locally cylindrical part into a tubular part in a cruciform arrangement, i.e. the pressing of this at least locally cylindrical part into the tubular part globally transversely to the lengthwise direction of the latter.

By "at least locally cylindrical part" is meant here a part the exterior surface of which is, at least locally where it is pressed into the tubular part, a cylindrical surface, i.e. a surface which, regardless of the circular or other nature of the contour of its cross-section, is formed of parallel generatrices.

This at least locally cylindrical part, which for convenience will be referred to hereinafter simply as the cylindrical part, can be solid, hollow or tubular.

In the case of a hollow or tubular part it can serve as a housing for at least one other component of any kind.

By "tubular part" is meant here a part which, whilst being globally elongate in the form of a tube, being open at one end at least, can be shaped to a greater or lesser degree, for example more or less curved or bent, and which has any cross-section.

BACKGROUND OF THE INVENTION

The assemblies formed of a cylindrical part pressed into a tubular part of the above kind in a cruciform arrangement can have applications in themselves, in particular by virtue of the particular assembly of the parts that constitute them, but they can also find applications in assembling other components connected to one or other of these parts, for example in automobile construction.

To enable them to be assembled by pressing, a hole is formed through the tubular part, perpendicular to its lengthwise direction and adapted to envelope the overall contour of the cylindrical part, and the cylindrical part and the tubular part are conjointly subjected, for example in a press, to a relative movement such that the cylindrical part is forcibly inserted into the hole in the tubular part from one side of the latter with the tubular part braced externally on the opposite side.

Various problems have to be overcome in carrying out pressing operations of this kind.

Firstly, to avoid deformation of the tubular part when the hole is formed in it, a machining process is normally required, with the cost penalty of using relatively complex and costly tooling.

Then, the tubular part forming two walls around its hole, by virtue of its tubular structure, the wall which is on the side from which the cylindrical part is inserted is the first to be subjected to the pressing force and therefore can itself be subject to some deformation.

If this occurs, the cross-section of the tubular part is modified around its hole and this can compromise the quality of the mechanical joint between it and the cylindrical part and therefore the durability of the assembly.

In any event, the resulting visible deformation of the tubular part is bound to cast some doubt on this durability and the assembly must therefore normally be discarded.

Furthermore, even in the absence of any deformation of either wall of the tubular part, the surface area of contact between the tubular part and the cylindrical part is reduced to that of the edge of the walls of the tubular part around its hole.

The quality of the mechanical joint is dependent on this contact surface area.

In practice, in some applications at least, in which the parts concerned are subject to a tear-out force and/or to vibrations, the contact surface area may be insufficient to assure a durable assembly.

To overcome this latter problem at least in part, Swiss patent No. 383 303 proposes the formation of an upstanding rim around the hole in at least one of the walls of the tubular part, in practice in both of them.

According to the above Swiss patent the tooling used for this purpose is a punch with a pointed end in the form of a blade so that, to form the upstanding rim, the wall concerned is simply pushed back laterally on either side of this blade.

As a result the upstanding rim obtained does not extend around all of the perimeter of the hole that it borders and its height varies between the two ends of the diameter of the hole, from a zero height at these two ends to the detriment of the reinforcement.

Moreover, and most importantly, the risk of deformation of one or other of the walls of the tubular part during pressing of the cylindrical part into the hole in the latter is virtually unchanged.

SUMMARY OF THE INVENTION

An aim of the present invention is an arrangement whereby such deformation can be prevented and which further yields other advantages.

To be more precise, it consists firstly in a method of pressing an at least locally cylindrical part, referred to herein for convenience as the cylindrical part, into a tubular part, globally transversely to the latter, this method being of the kind in which, a hole in the tubular part that has substantially the overall contour of the cylindrical part adapted to pass completely through both of two walls of the tubular part that the tubular part forms globally transversely around it, there is formed, over at least a portion of the perimeter of this hole, for at least one of the walls of the tubular part, an upstanding rim which, attached to this wall, extends towards the other wall of the tubular part, and the cylindrical part and the tubular part are conjointly subjected to a relative movement as a result of which the cylindrical part is forcibly inserted into the hole into the tubular part from one side of the latter while the tubular part is braced externally on the opposite side, and being generally characterized in that prior to formation of the upstanding rim on the tubular part, there is inserted into the latter a spacer adapted to brace it internally in the vicinity of its hole over at least a portion of the perimeter of the latter.

This spacer prevents any deformation of the wall of the tubular part at risk of such deformation, i.e. the wall on the side from which the cylindrical part is inserted.

Because of the upstanding rim bordering the hole in the tubular part, the surface area of contact between the tubular part and the cylindrical part is significantly increased, to the benefit of the durability of the assembly, and an upstanding rim of this kind is preferably formed on both walls of the tubular part around the entire perimeter of the corresponding hole, and with a substantially constant height all around the latter.

The upstanding rim or rims employed in this manner can be formed by punching, the spacer inside the tubular part forming therein a die enabling such punching without deformation of the wall concerned.

In accordance with the invention, additional benefit may be obtained from this spacer when forming the required hole.

For this purpose, the spacer is placed in the tubular part before the hole is formed and a hole, in this instance a preliminary hole, is simply punched out of the tubular part.

Unlike the tooling used for machining, the tooling used for is advantageously very simple and inexpensive.

It has the further advantage that there is no problem of swarf and is not subject to wear.

Finally, this tooling is advantageously suitable for use on a standard machine, in this instance a simple press, and more particularly on a simple hydraulic press, requiring no specific modifications.

The overall result of this is great economy of use and manufacture.

The present invention further consists in tooling suitable for implementing the method in accordance with the invention and any assembly resulting from such implementation comprising two parts pressed together in a cruciform arrangement, namely an at least locally cylindrical part and a tubular part having a transverse hole in it in which the at least locally cylindrical part is forcibly inserted.

In accordance with the invention, an assembly of the above kind is normally advantageously free of any deformation, the spacer internally bracing the wall of the tubular part on the side from which the at least locally cylindrical part is inserted into the hole in the tubular part.

BRIEF DESCRIPTION OF THE DRAWINGS

The invention, its features and its advantages will become apparent from the following description given by way of example with reference to the accompanying diagrammatic drawings, in which.

DETAILED DESCRIPTION OF THE INVENTION

Figure 1:
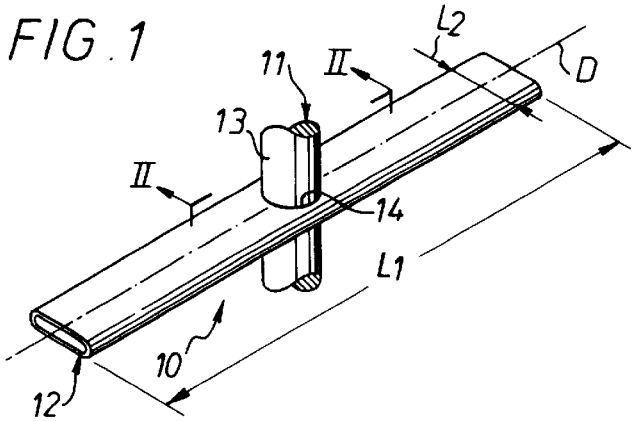
FIG. 1 is perspective view of an assembly formed of two part pressed together is a cruciform arrangement in accordance with the invention.
Figure 5:
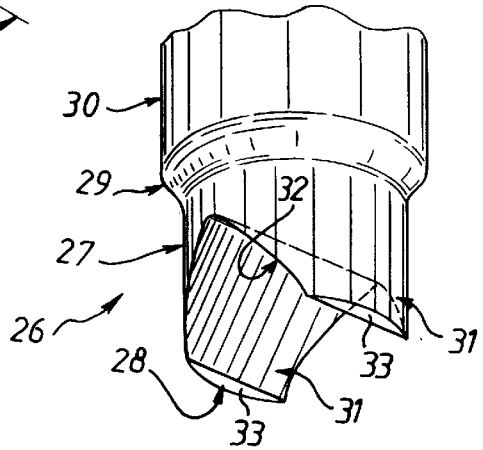
FIG. 5 is a partial perspective view of one of the punches used for this production.
Figure 2:
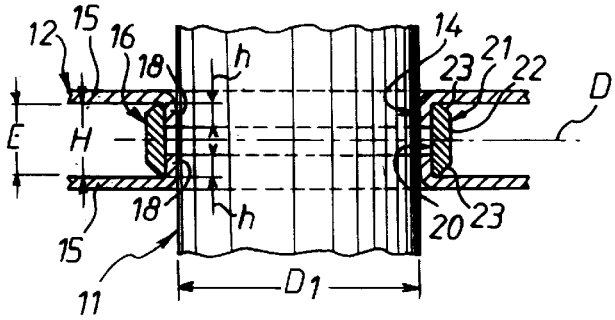
FIG. 2 is a partial view of this assembly in longitudinal section taken along the line II—II in FIG. 1 and to larger scale.
Figure 6:
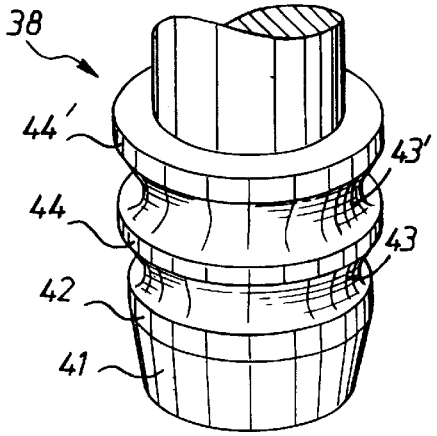
FIG. 6 is a partial perspective view of another of the punches also used.
Figure 3:
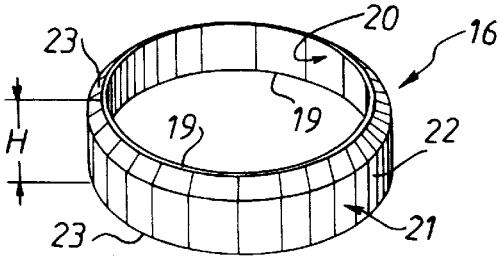
FIG. 3 is a perspective view of the spacer used in this assembly shown in isolation and to a different scale.

As shown in the figures, an assembly 10 is formed of two parts pressed together in a cruciform arrangement, namely a cylindrical part 11 and a tubular part 12, as seen best in FIG. 1.

As mentioned above, the cylindrical part 11 is defined as a part the exterior surface 13 of which is a cylindrical surface at least locally, i.e. where it is pressed into the tubular part 12.

In the embodiment shown the cross-section of this exterior surface 13 has a circular contour and is continuous.

It could instead have any other contour and/or be indented to a greater or lesser degree.

In the embodiment shown, the cylindrical part 11 is a solid rod.

However, it could instead be hollow, for example a tubular bush, to provide a housing for any other component, not shown.

The tubular part 12 has a lengthwise direction D to which the generatrices of the exterior surface 13 of the cylindrical part 11 are substantially orthogonal.

This lengthwise direction D is shown in chain-dotted line in FIGS. 1, 2, 4A, 4B, 4C, 4D, 4E and 4F.

The tubular part 12 can have any length L1 in its lengthwise direction D.

In the embodiment shown the tubular part 12 is an elongate part, for example, i.e. its length L1 is relatively great, in particular compared to its width L2.

The tubular part 12 can have any cross-section.

In the embodiment shown this cross-section is a flat slot, for example, substantially perpendicular to the generatrices of the exterior surface 13 of the cylindrical part 11.

Moreover, in this embodiment, this cross-section is uniform over the entire length L1 of the tubular part 12.

This is not necessarily so, however, and to the contrary the cross-section of the tubular part 12 could be modulated to a greater or lesser degree along its length L1.

It is sufficient for it to have a width L2 sufficient to receive the cylindrical part 11 at the location of the latter.

Finally, in the embodiment shown, the tubular part 12 is rectilinear or substantially rectilinear, for example.

This is not necessarily so either, however.

To the contrary, this tubular part 12 can instead be shaped to a greater or lesser degree.

It can be curved or bent to a greater or lesser degree, for example.

Be this as it may, the tubular part 12 features a transverse hole, to be more precise a hole transverse to it lengthwise direction D, to receive the cylindrical part 11, this hole 14 enveloping the overall contour of the cylindrical part 11, passing right through it and having the cylindrical part 11 forcibly inserted into it, in a manner to be described in more detail below.

There is therefore a hole 14 in both walls 15 of the tubular part 12 and the holes have a circular contour in the embodiment shown.

Let D1 denote the diameter of the hole 14.

In the embodiment shown, the hole 14 is at a distance from both ends of the tubular part 12, for example.

This is not necessarily so, however.

Finally, in the embodiment shown, and given the flat cross-section of the tubular part 12, the two walls 15 of the tubular part 12 are substantially plane at least near the hole 14.

However, this is not necessarily so either.

Let E denote the internal thickness of the tubular part 12 at the hole 14, i.e. the distance between the insides of its walls 15 at the hole 14.

Before the cylindrical part 11 is inserted in the hole 14 in the tubular part 12, and in a manner to be described in more detail below, an upstanding rim 18 is formed around at least a portion of the perimeter of the hole 14 on at least one of the walls 15 of the tubular part 12; attached to this wall 15, it extends towards the other wall 15 of the tubular part 12, substantially perpendicularly to the other wall 15.

In accordance with the invention, before this upstanding rim 18 is formed, a spacer 16 described in more detail below is inserted into the tubular part 12 to brace the tubular part 12 internally near the hole 14.

As in the embodiment shown, an upstanding rim 18 is preferably formed all around the perimeter of the hole 14.

The spacer 16 inserted into the tubular part 12 is preferably operative at least in the lengthwise direction D of the latter.

In other words, it is operative at least in the median area of the walls 15 of the tubular part 12, on either side of the hole 14 in the tubular part 12.

In the embodiment shown, the spacer 16 is circumferentially continuous and is therefore operative without discontinuity all around the hole 14.

Having the general form of a ring, the spacer 16 has an overall contour in plan that is globally similar to that of the hole 14 and, its diameter being greater than that of the hole, it extends coaxially around the latter.

The spacer 16 can have a rectangular or square profile in axial section, for example, and in practice the profile can be that most commonly used, the spacer 16 being formed by a section of tube, preferably metal tube, machined or not, for example.

However, in the embodiment shown, the spacer 16 has an isosceles trapezium shape profile in axial section.

To be more precise, in this embodiment, the spacer 16 has, in addition to flats 19 which truncate it transversely at its axial ends whilst being sufficiently wide for it resistance to compression not to be compromised, a globally cylindrical inside surface 20 and an outside surface 21 which has a globally cylindrical middle part 22 and frustoconical facets 23 at respective opposite axial ends of this middle part 22.

It is essentially the inside surface 20 which has an overall contour in plan globally similar to that of the hole 14 in the tubular part 12, a circular contour in this instance.

The spacer 16 preferably has good resistance to axial compression and good axial stiffness.

It is made from metal or from a hard synthetic material, for example.

In accordance with the invention, the spacer 16 is of benefit initially during the formation of the hole 14 in the tubular part 12.

Figure 4A:
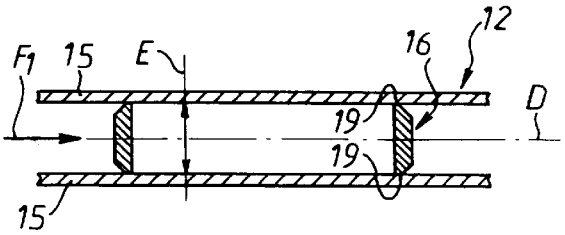
FIGS. 4A, 4B, 4C, 4D, 4E and 4F are partial views in longitudinal section which, is corresponding relationship to that of FIG. 2, show various successive phases in the production of the assembly in accordance with the invention.
Figure 4B:
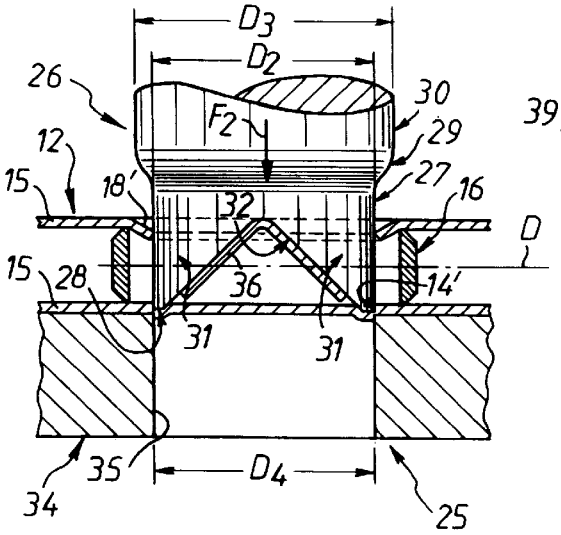
Figure 4C:
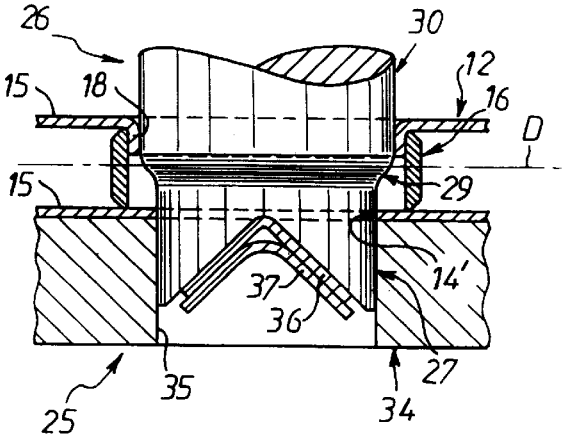

In accordance with the invention, the spacer 16 being fitted into the tubular part 12 before the hole 14 is formed, a preliminary hole 14' is punched out of the tubular part 12 (FIGS. 4B and 4C).

The spacer 16 is again of benefit during the formation of the upstanding rim 18.

In accordance with the invention, the upstanding rim 18 is preferably pressed into the wall 15 concerned.

In either case, i.e. upon forming the preliminary hole 14' or upon forming the upstanding rim 18, the spacer 16 serves as die for the wall 15 concerned of the tubular part 12.

As in the embodiment shown, an upstanding rim 18 is preferably formed on both walls 15 of the tubular part 12, along at least part of the perimeter of the hole 14, in practice along the whole of the latter.

The invention may be implemented in the following manner.

Initially (FIG. 4A) the spacer 16 is inserted into the tubular part 12 from one end and in the direction of the arrow F1 in FIG. 4A, until it is substantially at the location at which the hole 14 is to be formed.

In practice it can advantageously be inserted without great precision, the spacer 16 becoming centred relative to this location of its own accord upon forming the hole 14.

Nevertheless, the spacer 16 is preferably held in place in the tubular part 12 by appropriate means.

For example, the spacer 16 has a height H between its flats 19 substantially equal to the inside thickness E of the tubular part 12 or even slightly greater than this thickness E so that it has to be forcibly inserted between the two walls 15 and is then wedged between them.

However, if required, the spacer 16 can be held in position or its retention can be reinforced by other means, for example by mechanical means such as indentations obtained by local pressing of the tubular part 12.

Next (FIGS. 4B through 4E) the hole 14 and the upstanding rims 18 are formed.

The tooling employed to this end is in practice operative on a standard machine, in this instance a simple hydraulic press.

In accordance with the invention, this tooling 25 includes in succession, from the bottom upwards, a first stepped punch 26 having a first section 27 the free end 28 of which is adapted to punch out a preliminary hole 14', a second section 29 having a progressive transverse profile for coarse pressing and a third section 30 for finish pressing.

The diameter D2 of the first section 27 is much less than that D1 of the hole 14 to be formed. The diameter D3 of the third section 30 is substantially equal to (slightly less than) this diameter D1.

The free end 28 of the first section 27 of the punch 26 is preferably divided circumferentially into at least two lips 31 the edges of which are joined continuously to each other and thus form the cutting edge of the assembly.

In the embodiment shown there are only two lips 31.

They form internally a concave dihedron 32 the edge of which is substantially transverse to the punch 26.

The first section 27 of the punch 26 therefore has an inverted V-shape overall configuration.

In the embodiment shown the end of each of its lips 31 is blunted transversely by a flat 33.

The tooling 25 also includes, for bracing the tubular part 12 to be worked, a die 34 in which there is a hole 35 the diameter D4 of which is substantially equal to (slightly greater than) the diameter D2 of the first section 27 of the punch 26.

When one of the walls 15, referred to hereinafter as the second wall 15, of the tubular part 12 has been applied to the die 34, being appropriately held in place on the latter by clamping means of the usual type (not shown), the punch 26 vertically above the hole 35 in the die 34 is moved towards the latter, in the direction of the arrow F2 in FIG. 4B.

The first section 27 of the punch 26 first cuts the other wall 15 of the tubular part 12, referred to hereinafter as the first wall 15, see FIG. 4B, bending the edge 18' of the latter slightly inwardly to form an upstanding rim 18, and then cuts the second wall 15, see FIG. 4C.

Because of the inverted V-shape configuration of this first section 27, the waste 36 from the first wall 15 of the tubular part 12 remains temporarily attached to it and is therefore unable to interfere with the path of movement of the first section 27 before the latter reaches the second wall 15 of the tubular part 12, which prevents it interfering with the cutting of the latter.

After it is separated from the first wall 15 the waste 36 is removed via the hole 35 in the die 34, together with the waste 37 from the second wall 15, see FIG. 4C.

The section 29 of the punch 26 completes the inward bending of the upstanding rim 18 formed from the first wall 15 and this bending is then confirmed by the third section 30, see FIG. 4C.

The tooling 25 includes a second punch 38 adapted thereafter to assure in succession stamping and finishing of the tubular part 12.

Figure 4D:
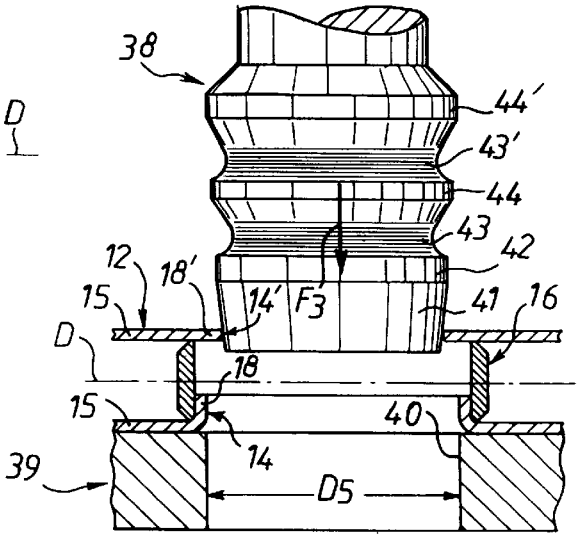
Figure 4E:
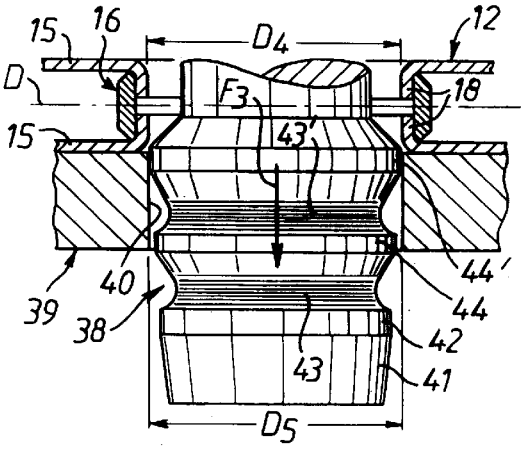

As shown in FIGS. 4D and 4E, in order for it to be worked by the second punch 38 the tubular part 12 is placed a new die 39 in which there is a hole 40 the diameter D5 of which is substantially equal to (slightly greater than) the diameter D1 of the hole 14 to be formed.

Like the first punch 26, the second punch 38 is a stepped punch.

In addition to a globally frustoconical first section 41 and a globally cylindrical second section 42 adapted to bend the upstanding rims 18 formed from the second wall 15 of the tubular part 12, it has in succession, from the top downwards, and alternating with connecting sections 43, 43', etc, at least one other section 44, 44', etc, that is globally cylindrical with a diameter greater than that of the second 42 for sizing the hole 14 thus obtained in a succession of passes.

As shown here, for example, a plurality of sections 44, 44', etc with increasing diameters is provided.

The second punch 38 vertically above the hole 40 in the die 39 is moved towards the latter in the direction of the arrow F3 in FIGS. 4D and 4E.

Figure 4F:
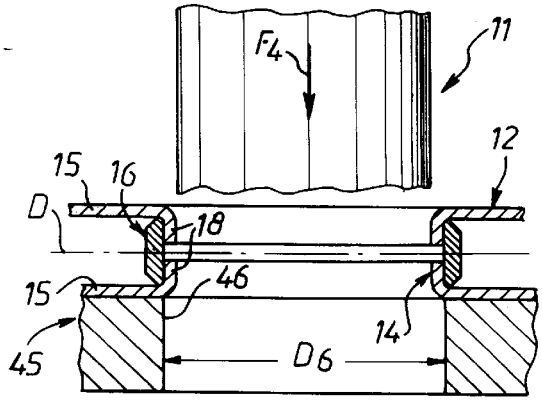

All that remains, also on the press, is to submit the cylindrical part 11 and tubular part 12 conjointly to relative movement such that the cylindrical part 11 is forcibly inserted into the hole 14 in the tubular part 12, in the direction of the arrow F4 in FIG. 4F, from a first side of the tubular part 12, with the tubular part 12 braced externally on the opposite side by a die 45 in which there is a hole 46 the diameter D6 of which is slightly greater than the diameter D1 of the hole 14 in the tubular part 12.

The pressing force developed is preferably monitored by strain gauges.

Note that the invention uses only one punch, in this instance the first punch 26, to punch a preliminary hole 14' in the tubular part 12 and to press one of the walls 15 of the latter.

It goes without saying that these two operations could nevertheless be carried out using different punches, if desired.

Be this as it may, it follows from the foregoing that the assembly 10 in accordance with the invention includes, between the two walls 15 that its tubular part 12 forms around its hole 14, a spacer 16 which extends around at least a portion of the perimeter of the hole 14 and the hole 14 in at least one of the walls 15 is bordered over at least part of its perimeter by an upstanding rim 18 attached to the wall 15 and extending towards the other wall 15 of the tubular part 12, substantially perpendicularly to the latter.

In the embodiments shown the upstanding rim 18 extends around all of the perimeter of the hole 14 in the tubular part 12 and is in one piece with the wall 15 of the latter concerned, and there is therefore an upstanding rim 18 on each of the walls 15 of the tubular part 12.

Furthermore, this upstanding rim 18 has a constant height h all around the hole 14, as measured from the inside surface of the walls 15.

Note that the hole 14 is defined by the upstanding rims 18 on the walls 15, to be more precise by the free external surfaces of these upstanding rims 18.

Defined in this way by these upstanding rims 18, the surface area of contact between the cylindrical part 11 and the tubular 12 is significantly greater than that of the edges of the walls 15 of the tubular part 12.

In the embodiment shown in FIGS. 1 through 6 the upstanding rims 18 are as close as possible to the spacer 16, being substantially in contact with it.

They are preferably pressed onto the spacer 16 in the radial direction.

In the embodiment shown in FIGS. 1 through 6 the free edges of the upstanding rims 18 are at a distance from each other, the height h of the upstanding rims 18, which is the same for each of them, being less than half the height H of the spacer 16.

This is not necessarily so, however.

Figure 7:
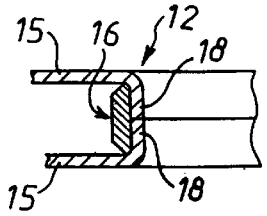
FIG. 7 is a partial view in longitudinal section relating to that of FIG. 2 and to one embodiment of the invention.

For example, see FIG. 7, the free edges of the upstanding rims 18 can be at least locally in contact with each other from place to place to increase the resistance to collapse during insertion of a cylindrical part 11, in parallel with the action exerted to this end by the spacer 16.

In all cases, the spacer 16 requires a maximal resistance to compression, both axially and radially.

The present invention is not limited to the embodiments and uses described and shown, but encompasses any variant thereof.

What is claimed is:

1. A tool for pressing a cylindrical part into a tubular part through a hole passing completely through opposite walls of the tubular part, which comprises a first stepped punch adapted to punch a preliminary hole, said first punch having a first section having a free end adapted to punch a preliminary hole in said tube and a second section with a progressive transverse profile adapted to perform coarse pressing and a third section adapted to perform finish pressing, the tool having a second stepped punch adapted to perform successive pressing and sizing, the second stepped punch having a frustoconical first section a cylindrical second section and, alternating with connecting sections of lesser diameter, at least one other cylindrical section having a diameter greater than the diameter of the second cylindrical section for sizing the hole obtained in a plurality of passes.

2. A tool as claimed in claim 1, having a free end which is circumferentially divided into at least two lips.

3. A tool as claimed in claim 2, wherein edges of said two lips are continuously joined together to form a cutting edge.

4. A cruciform assembly of a cylindrical part and a tubular part produced by the method of inserting a ring (16) into the tubular part, forming rims (18) extending toward each other from the material of opposite walls about a hole and within said ring, the ring having a height substantially equal to the distance between said opposite walls adjacent said hole, and pressing said cylindrical part through said hole.

5. An assembly as claimed in claim 4, wherein said rims extend about the entire periphery of the hole.

6. An assembly as claimed in claim 4, wherein each rim has a substantially constant height all around the hole.

7. An assembly as claimed in claim 4, wherein each rim is pressed against an inside surface of the ring.

8. An assembly as claimed in claim 4, wherein said rims have free edges spaced from each other in a direction parallel to the cylindrical part.

9. An assembly as claimed in claim 4, wherein the ring is a closed ring.

* * * * *